United States Patent [19]

Tomer

[11] Patent Number: 4,836,799

[45] Date of Patent: Jun. 6, 1989

[54] ELECTRICAL CABLE CONNECTOR

[76] Inventor: Jitendra P. Tomer, 169 Castlefrank Rd., Kanata, Ontario, Canada, K2L 1T3

[21] Appl. No.: 155,758

[22] Filed: Feb. 16, 1988

Related U.S. Application Data

[63] Continuation-in-part of Ser. No. 21,800, Mar. 4, 1987, abandoned.

[51] Int. Cl.[4] ..... H01R 13/28

[52] U.S. Cl. ..... 439/284; 439/289; 439/507

[58] Field of Search ..... 439/284, 286, 287, 289–291, 439/507, 510–512, 597, 722, 723

[56] References Cited

U.S. PATENT DOCUMENTS

| | | | |
|---|---|---|---|
| 3,638,164 | 1/1972 | Glance et al. | 439/284 |
| 4,501,459 | 2/1985 | Chandler et al. | 439/289 |
| 4,666,231 | 5/1987 | Sheesley et al. | 439/507 |

*Primary Examiner*—P. Austin Bradley
*Attorney, Agent, or Firm*—Pascal & Associates

[57] ABSTRACT

An electrical cable connector configured to physically and electrically mate and connect with an indentical such electrical cable connector. The cable connector includes both male and female connectors corresponding to each circuit lead of the cable configured to mate and electrically connect with the female and male connectors, respectively, corresponding to like circuit leads of another identical cable connector. The male connector is electrically insulated from its associated circuit lead when the cable connector is not electrically connected to a second cable conector and is electrically connected to the circuit lead when the cable connector is electrically connected to a second cable connector. The male connector is preferably a pin and the female connector a socket comprising two terminals electrically insulated from one antoher. The male pin is electrically connected to one of the terminals of the female socket. The other terminal of the female socket is electrically connected to the circuit lead with which the male pin and female socket are associated. The circuit between the pin and the circuit lead is completed through the associated socket when the pin of an identical such cable connector makes contact with both terminals of the socket.

7 Claims, 3 Drawing Sheets

ELECTRICAL CABLE CONNECTOR

This application is a continuation-in-part application of U.S. application No. 021,800 filed Mar. 4, 1987 now abandoned.

FIELD OF THE INVENTION

The invention pertains to a hermaphrodite-type electrical cable connector which, amongst other applications, may be used on a battery cable of an automobile battery access system.

BACKGROUND OF THE INVENTION

Cable connectors of various types are known in the industry many of which are either male-type or female-type connectors designed to mate with a corresponding female-type or male-type connector respectively. Another known type of cable connector is the hermaphrodite-type connector which comprises both the male and female-type connectors (i.e. pins and sockets) configured in such a manner that the cable connector is able to mate directly with a second identical cable connector. Still another type of connector is the alligator clip which is commonly used on the ends of cables to connect to battery or other circuit terminals. It is the latter type of connector which has traditionally been used in connection with automobile battery access systems i.e. jumper cable sets.

Certain disadvantages are associated with each of the above types of known cable connectors when used, for example, in connection with an automobile battery access system. Separate male and female-type connectors require that either mating female and male-type connectors be available when they are needed or a separate intermediary connector into which two non-mating connectors may be effectively electrically connected together. This results in inconvenience to the user who does not have on hand the correct type of connector at the time of need.

Hermaphrodite-type connectors eliminate this particular problem but may, depending upon their application, cause a shorting of the circuit to which they are connected. A danger of this happening occurs when the male connectors (e.g. pins) are exposed to the outside environment such that they might touch a nearby metal frame (or other conducting material) and thereby discharge the circuit to which they are connected.

Alligator clip cable connectors avoid the two above problems since they are neither male or female and remain unconnected to the circuit until they are used; however, confusion often arises when using such connectors as to the correct connection to be made with each alligator clip. Furthermore, to be useful, the alligator clip cable has to be available when needed which might not be the case since such cables are normally only connected to the circuit when being used. Accordingly, it is desired to provide a cable connector which avoids the above disadvantages when used in connection with (amongst other applications) an automobile battery access system.

SUMMARY OF THE INVENTION

In accordance with the present invention, there is provided an electrical cable connector of the hermaphrodite type configured to physically and electrically mate and connect with a second identical electrical cable connector. The cable connector comprises a male connector and female connector corresponding to each circuit lead (lead wire) of the cable, the male and female connectors being configured to mate and connect with the female and male connectors, respectively, of a second identical cable connector, in such a manner that the male connector is electrically insulated from the circuit lead when the cable connector is disconnected, but is electrically connected to the circuit lead when the cable connector is electrically connected to a second cable connector.

Preferably, the male connector of the cable connector is a pin and the female connector is a socket having two terminals, each of the two terminals of the socket being insulated from one another. The male connector pin electrically mates with the female connector socket in another identical such cable connector. One terminal of the socket is electrically connected to the pin on the same cable connector and the second terminal is electrically connected to the circuit lead. Thus in the disconnected mode, the pin is dead. The circuit is completed when the pin of one cable connector makes electrical contact with both terminals of the socket of another identical such cable connector, and vice versa.

Preferably, the male and female connectors and circuit leads of the cable connector are secured within a non-conductive thermoplastic body whereby the body around the male and female connectors is configured to physically mate with the female and male connectors, respectively, of a second identical cable connector.

Having summarized the invention above, a detailed description of the same is described below with reference to the following drawings.

DETAILED DESCRIPTION OF A PREFERRED EMBODIMENT

Figure 1:
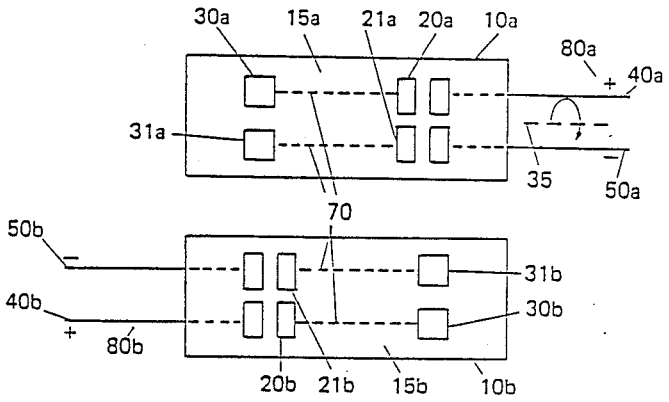
FIG. 1 is a schematic top view of two electrical cable connectors positioned in side-by-side relationship, each constructed in accordance with the present invention.

The top view of two identical cable connectors **10*a* and 10*b* constructed in accordance with the invention and positioned in opposed side-by-side relationship is shown in FIG. 1** of the drawings. For convenience of description, the upper cable connector is described with reference to alphanumeric reference numerals having the suffix a and the lower cable connector is described with reference to alphanumeric reference numerals having the suffix b, it being understood that any given component referred to by any given reference number followed by suffix a is identical to the same component having the same reference number followed by suffix b. Where in this description there is no need to single out either the upper or lower cable connector, the suffix letter a or b is omitted entirely.

A female connector 20 and an associated male connector 30 are associated with each positive circuit lead 40 of the cable connector 10. A female connector 21 and an associated male connector 31 are associated with each negative circuit lead 50 of the cable connector 10. As shown in FIG. 1, the female connectors 20, 21 are sockets into which the male connectors 30, 31, preferably being pins, may be connected. Depending upon the application, there may be only one pair of circuit leads per connector, permitting connection of only one circuit, as shown in FIG. 1 in which circuit lead 40 is the positive lead and circuit lead 50 is the negative lead. (However, the cable connector could be expanded to include any number of leads and circuits as desired.)

Each female socket 20 comprises a first terminal plate 22 connector to circuit lead 40 and a second terminal plate 24 connected by floating lead 70 to pin 30. The two terminals 22, 24 are electrically insulated from one another. The female socket 21 is preferably similarly formed.

The body 15 of the cable connector 10 is preferably comprised of a non-conductive thermoplastic material e.g. PVC (polyvinyl chloride) molded around connectors 20, 21, 30, 31, and leads 40, 50, 70. Preferably, the material of the body 15 is sufficiently resilient to resist chipping and the like and is able to withstand expected ambient temperatures. The cable connector 10 may be molded according to standard molding techniques.

Figure 2:
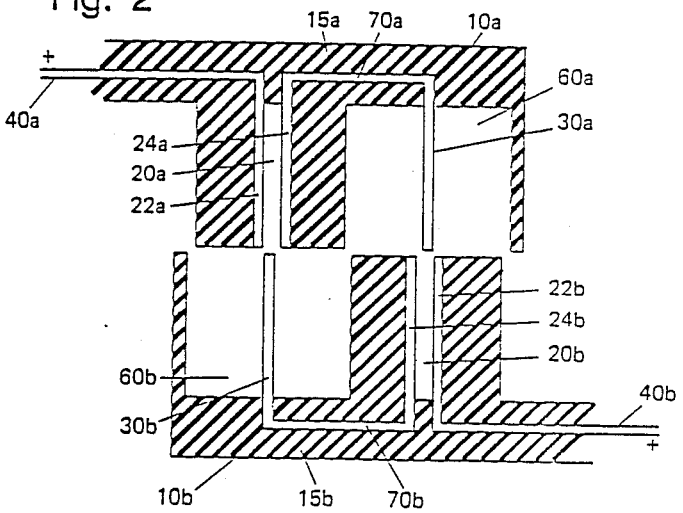
FIG. 2 is a schematic sectional elevation view of the cable connectors of FIG. 1 when the uppermost shown cable connector of FIG. 1 is rotated about its longitudinal axis in the direction of the arrow to a position in which it can be pushed into physical and electrical engagement with the lowermost shown connector of FIG. 1.

FIG. 2 of the drawings is a schematic sectional elevation view of the cable connectors of FIG. 1 when the upper cable connector **10*a* is placed above the lower cable connector 10*b* by rotating cable connector 10*a* about its longitudinal axis 35 in the direction indicated by the arrow in FIG. 1. FIG. 2 illustrates the positive circuit. The negative circuit is similarly formed. The male connector 30, when the two cable connectors 10*a*, 10*b* are separated from one another, is not electrically connected to the circuit lead 40. Rather, the male connector 30 is electrically connected through the floating lead 70 to terminal 24 of female connector 20 while terminal 22 of female connector 20 is electrically connected to the circuit lead 50. As shown in FIG. 2 (and FIG. 4), the first and second terminals 22, 24 of the female connector 20 are electrically insulated from one another. Therefore, the male connector pin 30 is electrically insulated from terminal 22 and thus from the circuit lead 50 when the cable connector is disconnected. In other words, pin 30** is "dead" when disconnected, thus presenting no risk of shock or short circuit.

Figure 3:
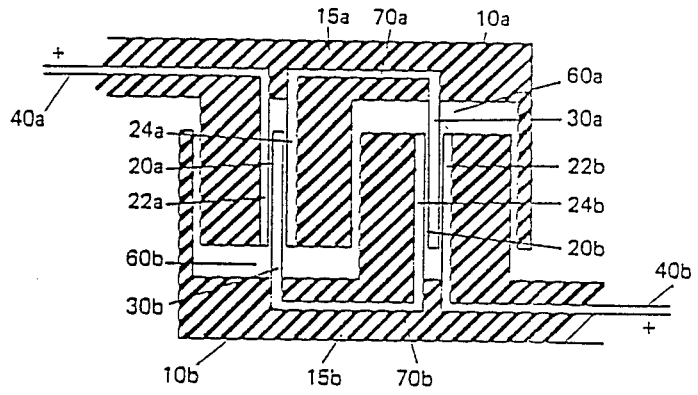
FIG. 3 is a schematic sectional elevation view of the cable connectors of FIG. 2, in which the lowermost cable connector has been pushed upwardly toward and partially into mating engagement with the uppermost cable connector.
Figure 4:
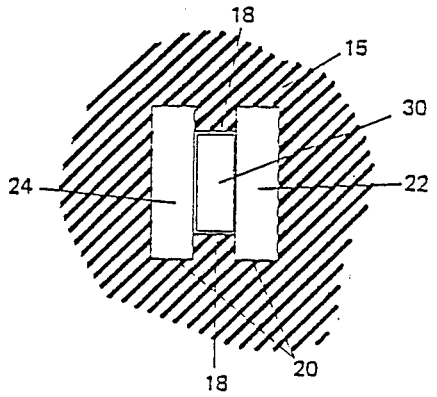
FIG. 4 is a schematic (enlarged) top cross-sectional view of the female connector of FIG. 1 with a male connector connected thereto.

However, upon physically (and electrically) connecting together the two cable connectors **10*a*, 10*b* by sliding one into the other as shown in FIG. 3, the male connector pin 30*a* of the cable connector 10*a* becomes electrically connected to the two terminals 22*b*, 24*b* of the female connector socket 20*b* of the second (identical) cable connector 10*b* and, thereby, also becomes electrically connected to the circuit leads 40*a*, 40*b* of the two cable connectors 10*a*, 10*b*, thus completing the circuit, as male pin 30*b* similarly makes contact with socket 20*a*. As shown in FIG. 4, the two terminals 22, 24 of the female connector socket 20 are separated at both ends by insulating ribs 18 comprised of the insulating material of the body 15. The male connector pin 30 fits snugly between the terminals 22, 24 and the insulating ribs 18. Thus, while in the disconnected mode, each male connector pin 30 is floating (i.e. electrically disconnected from circuit lead 40), pin 30 becomes electrically connected to circuit lead 40 when the cable connection 10*a* is connected to a second identical cable connector 10*b* as illustrated in FIG. 3. When such connection is made, the circuit lead 40*a* associated with the male connector pin 30*a* becomes electrically connected to the circuit lead 40*b* of the second identical cable connector 10*b*. As a result, the circuit leads 40*a*, 40*b* of the two cable connectors 10*a*, 10*b* are electrically connected as desired when they are physically connected. But when they are disconnected, the male connector pin 30** remains floating—i.e. disconnected or "dead" electrically.

As shown in FIGS. 1, 2 and 3 of the drawings, the body **15*a* of the cable connector 10*a* around the male and female connectors 20*a*, 21*a*, 30*a*, 31*a* is configured such that it physically mates with the body 15*b* of identical cable connector 10*b*, thus permitting physical mating of the respective female and male connectors of the two identical cable connectors 10*a*, 10*b*. The male connector pin 30 and female connector socket 20 are preferably secured within the body 15 such that the body encases the female connector socket 20 but is recessed to form a cavity 60 around the male connector pin 30. Using such a configuration, the two cable connectors 10*a*, 10*b* may be snugly coupled together thereby eliminating any need for additional means to secure together the two cable connectors 10*a*, 10*b*** (the frictional forces between the male and female connectors being sufficient in normal intended use to hold them together).

Figure 5:
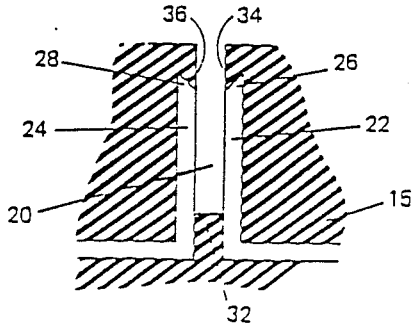
FIG. 5 is a schematic partial sectional elevation view of an alternative female socket configuration for use in the cable connector of FIG. 1.

In FIG. 4, terminal plates 22, 24 of socket 20 are kept spaced and insulated from one another by means of interposed insulating protruding ribs 18. Alternatively, as illustrated in FIG. 5, each of the terminal plates 22, 24 may be formed with an uppermost inclined portion 26, 28 respectively engaging and physically mating with similarly inclined recesses in the insulating material of body 15, such that overlapping retainer lips 34, 36 keep the plates 22, 24 separated at the top (as seen in FIG. 5) whilst rib 32 of body 15 between plates 22 and 24 keeps them separated and insulated from one another at the bottom of socket 20 (as seen in FIG. 5).

To use the cable connector 10 in connection with an automobile battery for jump-start purposes, one connects the ends 80 of the cable (comprising circuit leads 40, 50) remote from cable connector 10 to the battery terminals of the automobile. The connection to the battery can be relatively permanent if desired. The circuit leads 40, 50 should be covered with an appropriate insulating material and should be of sufficient length to enable the ends 80 of the leads to be connected to the battery terminals of one automobile while the cable connector 10 (at the opposite ends of the leads) is extendible to points outside the automobile for connection to a second identical cable connector 10 attached to a second automobile. When not in use, the cable may be hooked (or otherwise secured) to the frame of the automobile thereby ensuring that it will be available for use when required. The ends 80 of the cable preferably remain connected to the battery terminals when the cable is not in use.

In use, the cable connector 10 (with the attached cable connected to the automobile battery) is extended towards another automobile having an identical cable connector connected to its battery. The mating cable connectors of both automobiles are then connected together so as to electrically connect together the batteries of the two automobiles.

Figure 6:
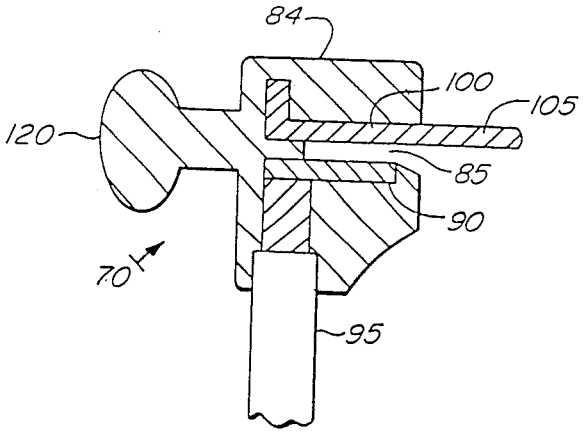
FIG. 6 illustrates in cross-section a second embodiment of the invention.
Figure 7:
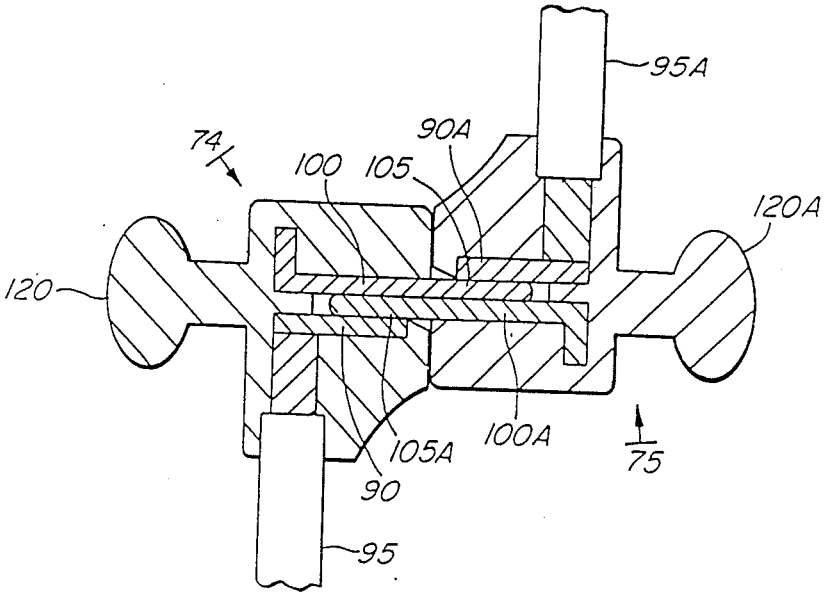
FIG. 7 illustrates the connector of FIG. 6 connected to a similar connector.

Another embodiment of the invention is illustrated in FIGS. 6 and 7. FIG. 6 shows one connector and FIG. 7 shows first and second identical connectors connected together.

In this embodiment the electrical cable connector 74 is configured to physically and electrically matingly connect with a second identical cable connector 75. The connector is comprised of an insulator contact retainer 84, e.g. molded of plastic, rubber, or the like. The contact retainer contains a socket 85, and a hidden first electrical contact 90 connected to a circuit lead 95, which contact 90 is disposed on one side of the socket, within and preferably imbedded in the side of the socket. A second electrical contact 100 is disposed on another side of the socket, insulated from the first contact, and extends out of the socket to form a conductive pin 105.

The cross-section of the socket 85 is matched to the cross-section of a pin 105A (which is identical to pin 105) in the second identical cable connector 75. Thus when pin 105A is inserted into the socket 85, it short circuits and connects contacts 105 and 90, allowing current to flow between the lead 95, first contact 90, pin 105A, pin 105, pin 90A of the second connector 75 and lead 95A of the second connector 75.

It is important that the use of this invention allows the leads 95 and 95A to be connected e.g. to automotive battery terminals, with the as yet unconnected connector end of the lead 95 and 95A swinging free, possibly in contact with the automobile body prior to being connected to anything, and the protruding pins 105 and 105A are electrically dead. There is thus no danger of short-circuiting the battery if the protruding pins touch each other or the automobile body, as in the case with common cable terminals.

Yet when corresponding pairs of identical connectors are connected together, the protruding pins short circuit between the protected live contact and the corresponding second contact and pin, allowing current to flow. The result is a safe electrical connector of which only one connector type need be fabricated and which will not inadvertently short circuit a battery when not yet connected to a corresponding second cable.

It is preferred that the socket 85 should have a depth at least as long as the pin extends outwardly from the surface of the connector. This will allow the connectors to mate solidly face to face. The contacts 90 and 90A should of course protrude slightly into the socket 85 to ensure that good electrical contact is made. Alternatively the pins 105 and 105A can be made in elongated sections slightly spring loaded in order to bow outwardly, in order to make good electrical contact to contacts 90 and 90A.

It is also preferred that the second contact should be placed directly across the socket from the first contact. Also, in order to easily disconnect the connectors, it is preferred that the contact retainer should be formed to include a knob 120, to extend outwardly from the rear of the contact retainer, for easy manual manipulation of the connectors.

As will be recognized by the reader, the cable connector which is described and claimed herein, is not limited for use with a battery jump-start connector system. The cable connector may be employed in any number of applications and the configuration of the cable connector may vary from the preferred embodiment described above, yet still fall within the scope of the appended claims which define the invention.

What is claimed is:

1. A hermaphrodite electrical cable connector configured to physically and electrically mate and connect with an identical such electrical cable connector, said cable connector comprising for each circuit to be connected a lead, a male connector and female connector spaced from one another, said male and female connectors being configured to mate physically and connect electrically with the female and male connectors respectively corresponding to the like circuit of an identical such cable connector, said male connector being electrically insulated from said lead when said cable connector is disconnected, and being electrically connected to said lead when said cable connector is electrically connected to an identical such cable connector, and wherein for each circuit the female connector is a socket comprising two closely spaced terminals electrically insulated from one another and extending no further than the entrance to the socket so as to be electrically unexposed externally of the socket, the male connector is an electrically conductive pin configured to mate with said socket, one of said terminals being electrically connected to the circuit lead, and the other of said terminals being connected to the pin, whereby in disconnected mode the pin is insulated from the circuit lead, and in the connected mode the circuit between the pin and the lead is completed by electrical contact of both terminals of the socket with the pin of an identical such cable connector.

2. An electrical cable connector according to claim 1, wherein said male and female connectors and circuit leads of said cable connector are secured within a non-conductive thermoplastic body, said body in the vicinity of said male and female connectors being configured to mate physically with the body in the vicinity of the female and male connectors respectively of an identical such cable connector.

3. An electrical cable connector configured to physically and electrically matingly connect with a second identical cable connector, comprising a contact retainer containing a socket, a first electrical contact, connected to a circuit lead, disposed within and on one side of the socket and terminating no further than the entrance to the socket so as to be electrically unexposed externally of the socket, and a second electrical contact disposed within and on another side of the socket, insulated from the first contact, and extending parallel to the axis of the socket out of the socket past the entrance to the socket to form a conductive pin, the cross-section of the socket being generally matched to the cross-section of an identical pin in said second identical cable connector whereby said identical pin is inserted into the socket, it connects the contacts, allowing current to flow between the lead, first contact, said identical pin, and said conductive pin.

4. A connector as defined in claim 3 in which the socket has depth at least as long as said pin extends outwardly from the surface of the connector.

5. A connector as defined in claim 4 in which the second contact is disposed across the socket from the first contact.

6. A connector as defined in claim 5 further including a knob extending outwardly from the rear of the contact retainer.

7. An electrical cable connector configured to physically and electrically matingly connect with a second identical connector, comprising a contact retainer containing a first socket, the contact retainer extending forwardly of a rear support, a second socket dimensioned to accommodate a contact retainer of the second connector located adjacent the contact retainer of the first connector, a first electrical contact disposed within and on one side of the first socket, and protruding no further than the entrance to the socket so as to be electrically unexposed externally of the socket, connected to a first circuit lead, a second electrical contact disposed within and on another side of the first socket, insulated from the first contact, and protruding no further than the entrance to the socket so as to be electrically unexposed externally of the socket, an electrically conductive pin extending outwardly from the bottom of the second socket, connected to the second electrical contact, whereby the pin is insulated from the circuit lead, the cross-section of the first socket being matched to the cross-section of the pin whereby when a pin of the second connector which is identical to the pin of the first connector is inserted into the first socket, and the contact retainer of the second connector extends into the second socket, a pin of the second connector short circuits between the two contacts of the first socket, and the pin of the first connector short circuits between corresponding contacts of a first socket of the second connector, thereby forming a complete conductive path between leads of the first and second connectors.

* * * * *